US005932156A

United States Patent [19]

Eriksson et al.

[11] Patent Number: 5,932,156

[45] Date of Patent: Aug. 3, 1999

[54] METHOD FOR PRODUCING LIGNOCELLULOSIC BOARDS

[75] Inventors: N. Lennart Eriksson, Sundsvall; Göran Lundgren, Alnö ; Kurt Schedin, Sundsvall; Kjell Sjödin, Bergeforsen, all of Sweden

[73] Assignee: Sunds Defibrator Industries AB, Sweden

[21] Appl. No.: 09/000,294

[22] PCT Filed: Jul. 25, 1996

[86] PCT No.: PCT/SE96/00974

§ 371 Date: Jan. 26, 1998

§ 102(e) Date: Jan. 26, 1998

[87] PCT Pub. No.: WO97/04932

PCT Pub. Date: Feb. 13, 1997

[30] Foreign Application Priority Data

Jul. 27, 1995 [SE] Sweden ..... 9502713

[51] Int. Cl.[6] ..... B27N 3/00

[52] U.S. Cl. ..... 264/83; 264/101; 264/102; 264/109

[58] Field of Search ..... 264/83, 109, 101, 264/102

[56] References Cited

U.S. PATENT DOCUMENTS

| | | | |
|---|---|---|---|
| 2,480,851 | 9/1949 | Goss . | |
| 4,684,489 | 8/1987 | Walter | 264/101 |
| 5,063,010 | 11/1991 | Fischer et al. | 264/109 |
| 5,433,905 | 7/1995 | Tisch | 264/83 |

FOREIGN PATENT DOCUMENTS

| | | |
|---|---|---|
| 2 058 820 | 5/1972 | Germany . |
| 36 40 682 A1 | 6/1988 | Germany . |
| 40 09 883 A1 | 10/1991 | Germany . |
| 502 272 | 9/1995 | Sweden . |
| 999696 | 7/1965 | United Kingdom . |
| 95/31318 | 11/1995 | WIPO . |

*Primary Examiner*—Mary Lynn Theisen

*Attorney, Agent, or Firm*—Lerner, David, Littenberg, Krumholz & Mentlik, LLP

[57] ABSTRACT

Methods for the continuous production of compressed board from lignocellulosic fibrous material are disclosed. The methods include providing the lignocellulosic fibrous material in the form of particles or fibers, drying, gluing and forming the lignocellulosic fibrous material into the form of a mat, and compressing the mat in the presence of steam in a single step which includes applying a compression roller to the mat and applying steam through the compression roller.

10 Claims, 2 Drawing Sheets

METHOD FOR PRODUCING LIGNOCELLULOSIC BOARDS

FIELD OF THE INVENTION

The present invention relates to a method of producing lignocellulosic boards.

BACKGROUND OF THE INVENTION

Methods of producing boards of lignocellulosic material are well known and have significant practical applications. The methods of manufacturing include the following main steps: breaking up the raw material to particles having a suitable size and/or fibers, drying to a predetermined moisture ratio and gluing of the material before or after the drying step, forming the glued material into a mat, which may be constructed of several layers, possibly also cold pre-compressing, pre-heating, water spraying of the surfaces, and heat compressing under pressure and heat in a stroke compressor or a continuous compressor until the board is finished.

During conventional heat compressing, the compressed material is heated primarily by using heated coils from adjacent heating plates or the steel bands. These have a temperature of between about 150 and 200° Celsius depending on the type of product that is being compressed, the type of glue used, the desired capacity, etc. In this manner, the moisture in the material is evaporated closest to the heat sources so that a dry layer is developed in this area and the steam front gradually moves towards the center of the board from each side as the compression continues. When the dry layer has been developed this means that the temperature in this layer is at least 100° Celsius, which initiates the curing of conventional glues. When the steam front has reached the center, the temperature at the center has reached at least 100° Celsius and the boards even start to cure at their center, so that the compression can be stopped within a couple of seconds. This applies to situations when conventional urea formaldehyde glue (UF) and similar glues are used, such as melamine fortified (MUF) glue. When other glues, such as those having a higher curing temperature are used, then a higher temperature and a greater steam pressure is required in the board before any curing can begin.

To achieve the desired density, a compressor must apply a high surface pressure at a high temperature. This is not a problem for non-continuous compression in a so-called stroke compressor, but such compressors have other drawbacks, such as worse thickness tolerances, etc. When continuous compressors are used, the requirement for simultaneous high surface pressures and high temperatures have led to expensive high precision solutions with regard to the roller felt between the steel band and the heating plate positioned below. The method of providing heat to the board by means of heating coils makes the heating relatively time consuming, which results in long compression lengths (large compression surfaces).

The heating can also be achieved by delivering steam to the mat to be compressed. In this way, the heating time is drastically shortened and, in addition, the resistance of the material to compression is drastically reduced when steam is introduced so that less compression force and smaller compression surfaces are required. An injection box may be used to inject steam into the material mat, which, however, has certain drawbacks. To avoid these drawbacks, compression rollers have been developed that are perforated, and which function as a steam delivery member. Such an apparatus is disclosed in Swedish Patent No. 502,810.

Swedish Patent No. 502,272 describes a method that uses the advantages of steam heating in order to achieve the desired density profile of the finished board. The compression is performed in two steps wherein the mat in the first step is compressed to a moderate density having a substantially even density profile across the thickness thereof. In the second step, the mat is compressed to a higher density than the middle portion of the board. Between both of the steps the board is either fully cured or partially cured.

Although this represents an advance within the field of manufacturing particle boards, the method according to Swedish Patent No. 502,272 has the drawback that the two step compression with the intermediate step of curing makes the manufacturing process relatively complicated.

The use of steam injection for heating the material is well known in the industry. For example, European Patent No. 383,573; U.S. Pat. No. 2,480,851; British Patent No. 999,696; German Patent No. 2,640,686; German Patent Application No. 40 09 883; and Australian Patent No. 57390/86 show different examples of how steam is injected in continuous processes to produce fiber boards. Even these described processes require compression in two or more steps.

European Patent No. 383,572 further describes a process that only works with one compression step. In this process, the steam is introduced in a steam injection segment which apparently includes some type of conventional steam delivery through a steam box or similar device. When introducing steam in this manner, there is some sliding between the mat/weave and the steam box which creates substantial wear so that the sliding surfaces of the box must be replaced at regular intervals and problems with the sealing of the edges may occur as a result of the sliding of the fiber mat/weave relative to the steam box.

The object of the present invention is to provide a method of this kind that is simpler than the methods of the prior art and that avoids the drawbacks that are associated with conventional ways of introducing steam.

SUMMARY OF THE INVENTION

These and other objects have now been accomplished by the discovery of a method for the continuous production of compressed board from lignocellulosic fibrous material which comprises providing the lignocellulosic fibrous material in the form of particles and/or fibers, drying the lignocellulosic fibrous material, gluing the lignocellulosic fibrous material, forming the lignocellulosic fibrous material into a mat, and compressing the mat of lignocellulosic fibrous material into a compressed board in the presence of steam in a single step, the compressing of the mat comprising applying a compression roller to the mat, and applying the steam to the mat of lignocellulosic fibrous material through the compression roller. Preferably, the method includes applying the steam to the mat of lignocellulosic fibrous material in an amount such that any air contained in the mat is expelled from the mat.

In accordance with one embodiment of the method of the present invention, the method includes pre-conditioning the mat of lignocellulosic fibrous material prior to the compressing of the mat. In a preferred embodiment, the pre-conditioning step includes conditioning the mat of lignocellulosic fibrous material to a predetermined temperature, moisture content and density.

In accordance with another embodiment of the method of the present invention, the method includes heating the compressed board. Preferably, the heating of the compressed board includes maintaining the compressed board in a heating zone for a sufficient time period whereby the glue is substantially completely cured. In another embodiment, the heating of the compressed board includes maintaining the compressed board in a heating zone at a temperature substantially corresponding to the temperature during the compressing of the mat.

In accordance with another embodiment of the method of the present invention, the method includes post-conditioning the compressed board. In a preferred embodiment, the post-conditioning of the compressed board includes adjusting the moisture content of the compressed board and separating gases emitted from the compressed board. In another embodiment, the post-conditioning of the compressed board includes cooling the compressed board.

By analyzing the results of the methods described in Swedish Patent No. 502,272, it has been determined that the glue, which is already provided with the steam injection in connection with the first compression step, can be made to cure and be sufficiently strong to withstand the inherent spring back characteristics of the particles/fibers included in the lignocellulosic fibrous material. It is therefore possible to obtain a partially completed board in the first stage that has a thickness that generally corresponds to the desired thickness of the finished board. The board may require conditioning after the compression step.

By accomplishing the steam injected compression in only one compression step, a substantially easier and less expensive manufacturing process is obtained.

By also introducing steam in this only compression step through the rollers, the problems that are associated with conventional steam delivery methods are avoided. Preferably, the compressed board is permitted to pass through a heating zone. In this way, the glue which normally does not fully cure to full strength during the compression step, can cure to full strength in this zone.

Before and after the compression, the mat/weave is preferably conditioned.

BRIEF DESCRIPTION OF THE DRAWINGS

The method of the present invention is described in more detail below in the detailed description of a preferred embodiment of the invention with reference to the appended figures, wherein.

DETAILED DESCRIPTION

Figure 1:
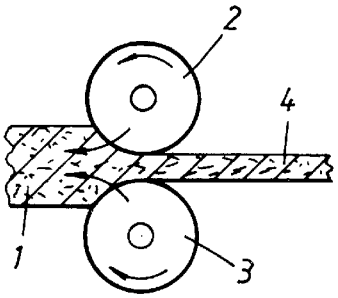
FIG. 1 is a cross-sectional view that schematically shows the compression step according to a first embodiment of the present invention.

Referring to the drawings, FIG. 1 illustrates the compression of a material mat 1, that includes, among other things, fibers and glue, in one single step in order to form a fiber board that has a thickness that substantially corresponds to the thickness of the finished board. The compression of the board 1 is performed by two compression rollers that include members for introducing steam to the mat in connection with the compression thereof. By introducing the steam to the mat, the glue components will cure and obtain a sufficient strength to withstand the spring back characteristics. This enables the compression of the board in one single step. The steam is pushed backwardly against the material, i.e. against the direction of movement of the material.

Figure 2:
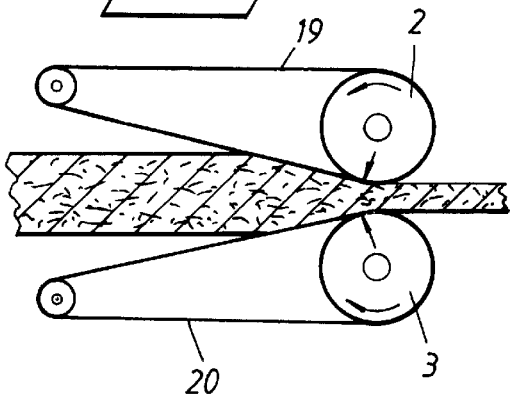
FIG. 2 is a cross-sectional view that corresponds to FIG. 1 but shows a second embodiment of the present invention.

FIG. 2 shows an alternative embodiment of the present invention where each roller, 2 and 3, is equipped with surrounding endless wires, 19 and 20, or in the alternative a steel band with holes and the endless wire.

Figure 3:
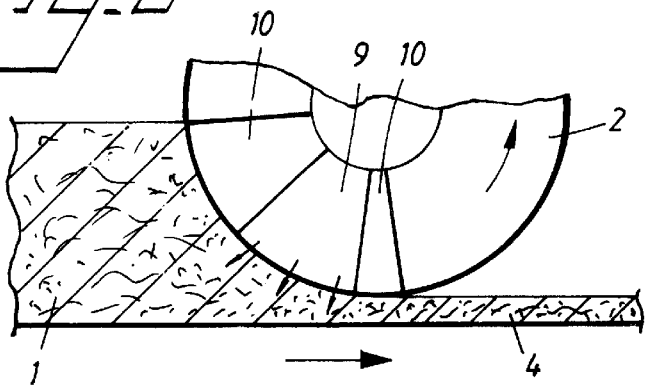
FIG. 3 is a schematic cross-sectional view of a roller through which steam is introduced.
Figure 4:
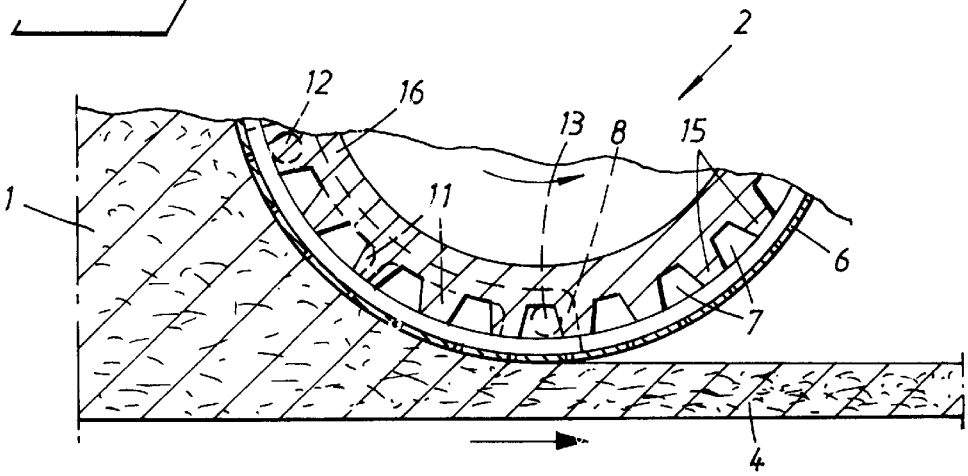
FIG. 4 is a cross-sectional view of a portion of FIG. 3.
Figure 5:
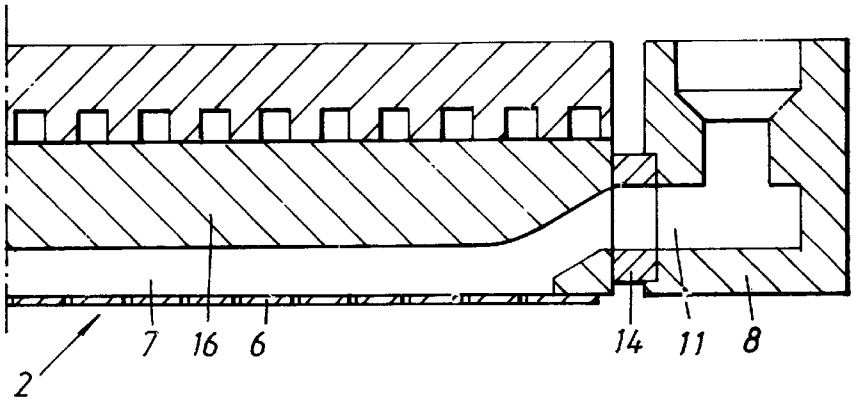
FIG. 5 is an axial cross-sectional view through the roller of FIG. 4.

The rollers 2 and 3, including the steam delivery systems, can be constructed in the manner described in Swedish Patent No. 502,810, and as shown in FIGS. 3, 4 and 5.

The compression and injection roller 2 that is shown in FIG. 4 is constructed with a perforated casing surface 6 for delivering steam to the mat 1. An axial channel system 7 is disposed inside the casing surface 6 around the roller 2. The channel system 7 is adapted to distribute the steam over the roller 2 and thus along the width of the mat 1. An adjustable sliding shoe (FIG. 5) is arranged to sealingly engage an end of the roller 2 to introduce steam into the channel system 7. The introduction of steam is thus performed to a limited section (FIG. 3) of the roller 2 where the mat 1 is compressed. The limited sector 9 is surrounded at both sides, as seen in the periphery, by sealing zones 10 where the roller 2 is in contact with the mat 1. The channel system 7 can be closed at the opposite end of the roller 2. In the alternative, a sliding shoe 8 can be disposed at each of the ends.

The sliding shoe 8 is held in place by an adjustable stand so that the sliding shoe is adjustable along the direction of the periphery. In this manner, the position of the injection sector 9 can be varied. The sliding shoe 8 preferably includes a replaceable wear part 14 made of a low friction material that bears against a treated surface on the end of the roller 2. Thus, the sliding shoe 8 is held and pushed against the end of the roller 2 by, for example, springs, compressed air or hydraulically, so that any leakage in the sealing surface is minimized.

The sliding shoe 8 can be constructed with one or more channels, 11, 12 and 13, that can have different surface areas. Even replaceable wear parts 14 having different openings defined therein may be used, such as a sliding plate having an opening that can be varied. Thus, the size of the injection sector 9 can be varied. What is more, different flows and pressures can be maintained in different parts of the injection sector 9. The channels of the sliding shoe 8 can also be used for cleaning and suction.

FIG. 5 schematically shows the contact surface of the sliding shoe 8 against the end of the roller 2. In this way, the sliding shoe 8 is equipped with injection channels 11 for steam, cleaning channel 12 and suction channel 13.

The perforated casing surface 6 on the roller 2 can be stamped or drilled sheet metal having the shape of rings that have been heat shrunk onto the roller. Axial support moldings 15 for the sheet metal can be shaped into the casing sheet metal 16 on the roller by milling or casting, or the sheet metal may be constructed as separate moldings that are attached to recesses in the casing sheet metal 16. These moldings can at the same time limit the channel system 7 disposed inside the casing surface 6.

The openings of the channel system 7 at the end of the roller that have not been covered by the sliding shoe 8 can be sealed by pressing an adjustable sliding ring made of a low friction material against the end.

Figure 6:
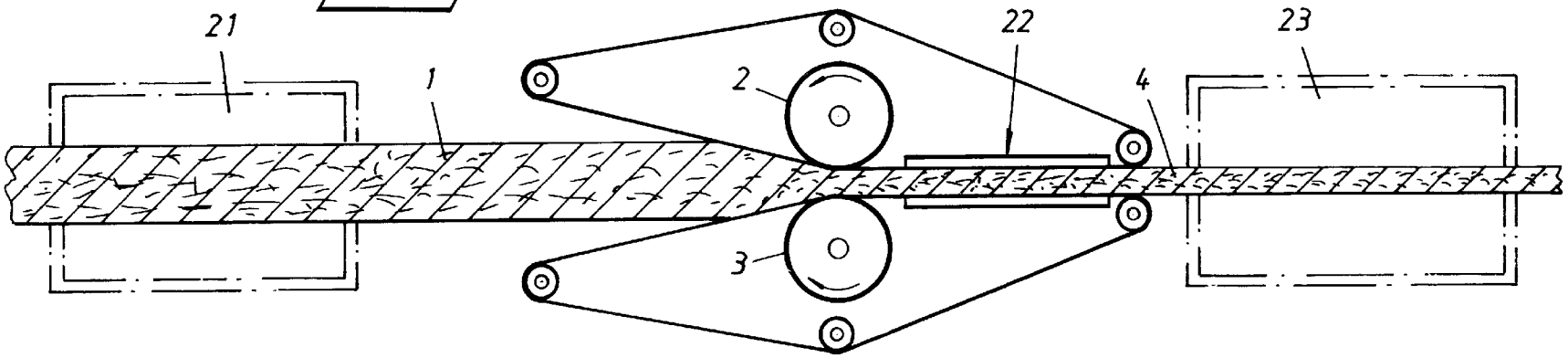
FIG. 6 is a schematic cross-sectional view that illustrates the different treatment steps according to a preferred embodiment of the present invention.

FIG. 6 shows a one step compression according to the present invention including the various treatment steps that preferably occur before and after the actual compression. The material mat 1 is first passed through a pre-conditioning zone 21 where it is conditioned to a predetermined temperature, moisture content and density.

After the compression between the rollers, 2 and 3, the compressed board 4 is passed through a heating zone 22. In this zone, the glue, that has been sufficiently cured in connection with the compression and is sufficiently strong to withstand the spring back characteristics of the fibers, is permitted to cure completely. To achieve an optimal strength in the finished board 4, the temperature in the heating zone is the same or very close to the temperature at the nip rollers.

The fully cured board is then finally passed to an after-conditioning zone 23. In this zone, the board is given the moisture content that is desired for the finished product. Furthermore, gases are collected in this zone, such as formaldehyde that is emitted by the compressed board. The board is also cooled in the conditioning zone because the high temperature of the board provided by the heating zone 22 makes the board plastic to a certain degree which gives it poor handleability.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for the continuous production of compressed board from lignocellulosic fibrous material comprising providing said lignocellulosic fibrous material in the form of particles and/or fibers, drying said lignocellulosic fibrous material, gluing said lignocellulosic fibrous material, forming said lignocellulosic fibrous material into a mat, and compressing said mat of lignocellulosic fibrous material into a compressed board in the presence of steam in a single step, said compressing of said mat comprising applying a compression roller to said mat, and applying said steam to said mat of lignocellulosic fibrous material through said compression roller.

2. The method of claim 1 including applying said steam to said mat of lignocellulosic fibrous material in an amount such that any air contained in said mat is expelled from said mat.

3. The method of claim 1 including pre-conditioning said mat of lignocellulosic fibrous material prior to said compressing of said mat.

4. The method of claim 3 wherein said pre-conditioning step includes conditioning said mat of lignocellulosic fibrous material to a predetermined temperature, moisture content and density.

5. The method of claim 1 including heating said compressed board.

6. The method of claim 5 wherein said heating of said compressed board includes maintaining said compressed board in a heating zone for a sufficient time period whereby said glue is substantially completely cured.

7. The method of claim 5 wherein said heating of said compressed board includes maintaining said compressed board in a heating zone at a temperature substantially corresponding to the temperature during said compressing of said mat.

8. The method of claim 1 including post-conditioning said compressed board.

9. The method of claim 8 wherein said post-conditioning of said compressed board includes adjusting the moisture content of said compressed board and separating gases emitted from said compressed board.

10. The method of claim 8 wherein said post-conditioning of said compressed board includes cooling said compressed board.

* * * * *